United States Patent [19]

Clyburn

[11] 4,319,512

[45] Mar. 16, 1982

[54] CAPOTASTO

[75] Inventor: C. Wayne Clyburn, Cincinnati, Ohio

[73] Assignee: James David Mfg. Corp., Creve Coeur, Mo.

[21] Appl. No.: 169,774

[22] Filed: Jul. 17, 1980

[51] Int. Cl.[3] ..... G10D 3/04

[52] U.S. Cl. ..... 84/318

[58] Field of Search ..... 84/318

[56] References Cited

U.S. PATENT DOCUMENTS

| | | | |
|---|---|---|---|
| D. 257,988 | 1/1981 | Nakamoto | D17/20 |
| 480,429 | 8/1892 | Johnsen | 84/318 |
| 583,102 | 5/1897 | Utt | 84/318 |
| 656,904 | 8/1900 | Pletcher | 84/318 |
| 1,007,960 | 11/1911 | Moore | 84/318 |
| 4,104,947 | 8/1978 | Oster | 84/318 |

*Primary Examiner*—Lawrence R. Franklin

*Attorney, Agent, or Firm*—Wood, Herron & Evans

[57] ABSTRACT

A capotasto having a force plate of a length sufficient to overlie two adjacent frets on a stringed instrument's fingerboard. The capotasto's leading edge portion is adapted to press the instrument's strings against a leading fret of two adjacent frets, and the capotasto's trailing edge portion is adapted to press the instrument's strings against the trailing fret of the two adjacent frets. The capotasto's force plate may be flexible in order to generally conform to the curvature or linearity of the instrument's frets when the capotasto is clamped in place on the adjacent frets.

8 Claims, 7 Drawing Figures

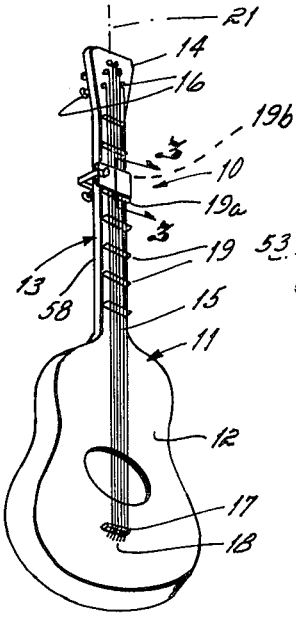
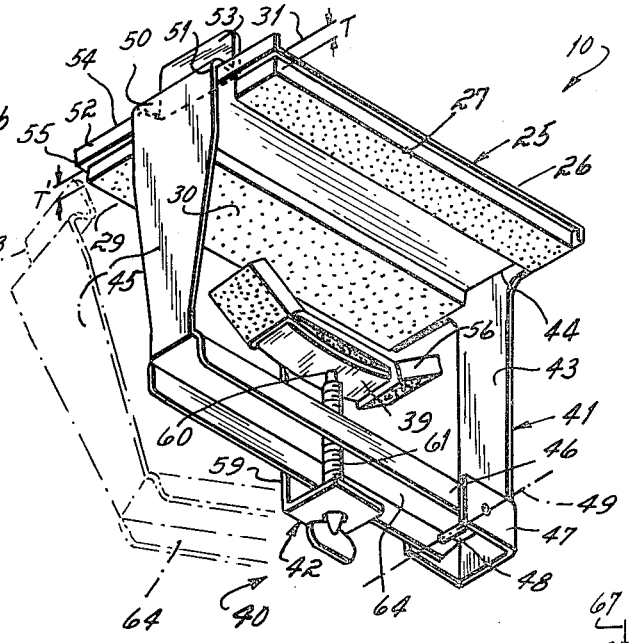
Fig. 1
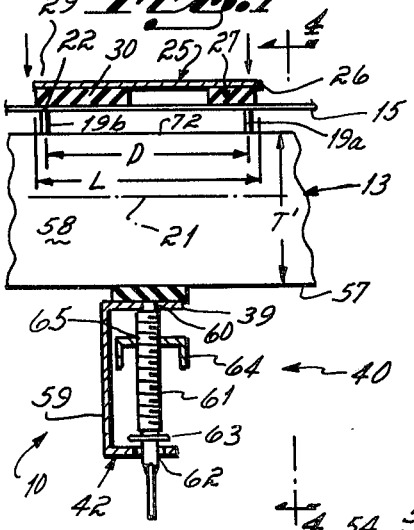
Fig. 2
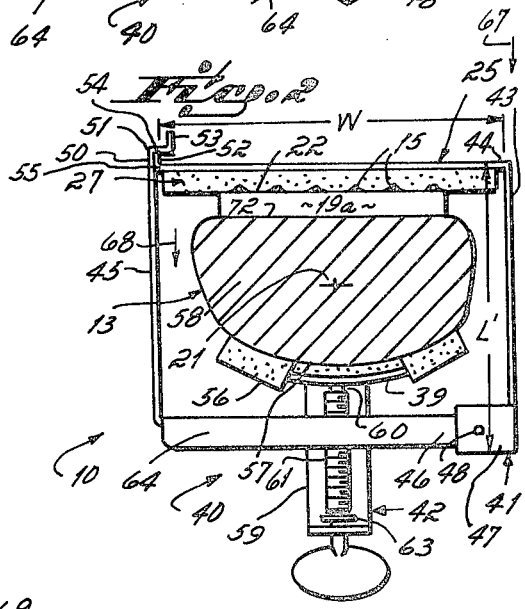
Fig. 3
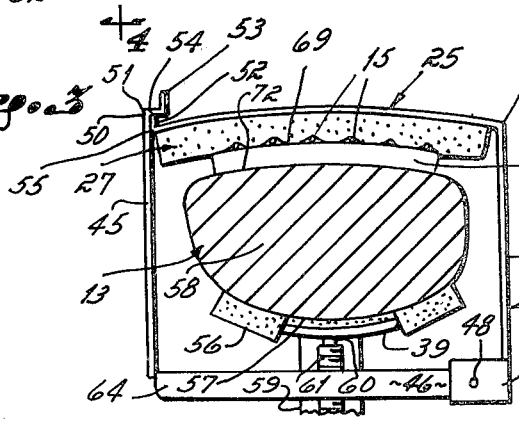
Fig. 4
Fig. 5

CAPOTASTO

This invention relates to capotastos.

Capotastos are well known to the art. A capotasto is used in combination with a stringed instrument of the type having a fretted fingerboard. Typical of such stringed instruments are guitars, banjos, and ukeleles. In each of these instruments, the instrument's fingerboard is provided with a series of frets that are spaced one from the other along the fingerboard's length.

The basic function of a capotasto is to adjust the pitch of all strings simultaneously up or down the musical scale. This is the case whether the instrument has twelve strings, or whether the instrument has six strings, or more or less. Every capotasto basically incorporates a force bar and a clamp mechanism. In those capotastos most commonly available, the capotasto's force bar is structured to overlie the instrument's strings along the fingerboard between two adjacent frets. When the capotasto is installed during use, its clamp mechanism cooperates with its force bar to tighten the force bar in clamping relation with the instrument's fingerboard and strings so that the force bar presses the instrument's strings down against the fingerboard. This tends to bow the instrument's strings between two adjacent frets but, of course, serves the function of simultaneously adjusting all the strings' pitch up or down the musical scale for all such strings. The primary problem associated with this basic type of capotasto, i.e., the common and commercially available type where the instrument's strings are pressed or clamped against the instrument's fingerboard, is that bowing of the strings downwardly between adjacent frets against the fingerboard tends to render the instrument out of tune immediately after the capotasto is installed. This, in turn, requires that the instrument be re-tuned, i.e., that the pitch of the strings be adjusted, after the capotasto is installed to maintain the pitch of the strings that proves desirable to the instrument's musician. Typical of such capotastos are those illustrated in U.S. Pat. Nos. 608,278, 2,604,805, and 4,143,576.

There has been recently developed a capotasto by means of which the strings of a fretted stringed instrument are clamped against a single fret, and not against the instrument's fingerboard. This capotasto structure is illustrated in U.S. Pat. No. 4,104,947. But in practice, the capotasto structure shown in the aforementioned patent is somewhat difficult to install, and is somewhat difficult to move down the fingerboard from the instrument's peg head toward the instrument's body. Further, the capotasto shown in that patent is somewhat sensitive to the clamping pressure introduced thereon by that capotasto's clamp mechanism.

Therefore, it has been the primary objective of this invention to provide an improved capotasto for use with a fretted stringed instrument, the capotasto incorporating a novel force plate structure which permits the capotasto to be installed with the stringed instrument in overlying fashion relative to two adjacent frets, the capotasto force plate being supported at both the leading fret and the trailing fret of the two adjacent frets, thereby preventing significant bowing of the instrument's strings between those frets.

It has been another objective of this invention to provide an improved capotasto for a fretted stringed instrument in which the capotasto's force plate is adapted to flex in response to the capotasto's clamp mechanism, the force plate being deformable between a generally linear cross section and a generally curved cross section depending on whether the capotasto is used with a stringed instrument having a curved fingerboard or a flat fingerboard.

It has been still another objective of this invention to provide an improved capotasto having a novel clamp mechanism, that novel clamp mechanism incorporating a latch which permits the capotasto's force frame to be easily connected to, and disconnected from, the capotasto's force plate for ease of installing and removing the capotasto relative to the stringed instrument's fingerboard.

In accord with the objectives of this invention, this invention contemplates a capotasto which incorporates a force plate of a length sufficient to overlie two adjacent frets on a stringed instrument's fingerboard. The capotasto's leading edge portion is adapted to press the instrument's strings against a leading fret of two adjacent frets, and the capotasto's trailing edge portion is adapted to press the instrument's strings against the trailing fret of the two adjacent frets. The capotasto's force plate may be flexible in order to generally conform to the curvature or linearity of the instrument's frets when the capotasto is clamped in place on the adjacent frets. The capotasto, in one preferred form, also includes a novel releasable clamp mechanism which permits the capotasto to be easily installed upon, and removed from, the stringed instrument's fingerboard. The clamp mechanism includes a force frame with, as a part thereof, an angled latch member that pivots on an axis parallel to the fingerboard's longitudinal axis but located behind the instrument's neck relative to the fingerboard.

Other advantages and objectives of this invention will be more apparent from the following detailed description taken in conjunction with the drawings in which:

FIG. 1 is a perspective view illustrating one embodiment of an improved capotasto in accord with the principles of this invention, the capotasto being shown assembled with a stringed instrument's fretted fingerboard;

FIG. 2 is a perspective view of the capotasto shown in FIG. 1;

FIG. 3 is a cross-sectional view taken along line 3—3 of FIG. 1;

FIG. 4 is a cross-sectional view taken along line 4—4 of FIG. 3;

FIG. 5 is a cross-sectional view similar to FIG. 4, but illustrating the capotasto in assembly with a curved fingerboard;

Figure 6:
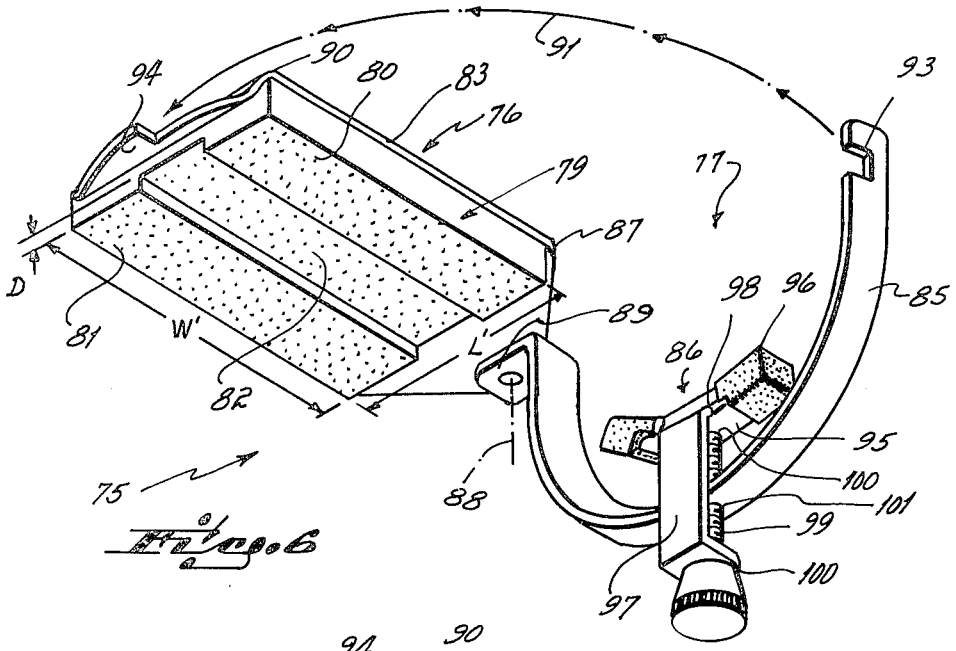
FIG. 6 is a perspective view of a second embodiment of an improved capotasto in accord with the principles of this invention, the capotasto being shown in an open condition.

The caspotasto 10 in accord with this invention is shown installed on a fretted stringed instrument 11 in FIG. 1. The instrument 11 is a guitar having a body 12, a fingerboard 13, and a peg head 14. The guitar's strings 15 stretch from pegs 16 at the peg head 14 over a bridge 17 on the body 12 where they are attached to the body as at 18. The strings 15 are adapted to cooperate with a series of frets 19, as selected by the musician playing the guitar 11, for the purpose of shortening or lengthening the strings' length and, therefore, for the purpose of changing the musical notes provided by the guitar. The fingerboard's frets 19 are parallel one to the other, and are spaced one from another, along the length of the fingerboard 13, and the frets are disposed perpendicular to the fingerboard's longitudinal axis 21. As shown in FIG. 4, the fingerboard 13 is a planar fingerboard, and the string contact edge 22 of each fret 19 is, therefore, linear.

The capotasto 10 in accord with the principles of this invention is more particularly illustrated in FIG. 2. The capotasto 10 includes a force plate 25 having a length L great enough to overlie two adjacent frets 19*a*, 19*b* on the guitar's fingerboard, as shown in FIG. 3. In other words, the force plates' length L is longer than the distance D between adjacent frets 19*a*, 19*b*. This length L of the force plate 25 is important relative to the advantages and features of this novel capotasto, and same will be more particularly described in detail below. The force plate also is of a width W sufficient to overlie all strings 15 on the guitar's fingerboard 13, see FIG. 4. The force plate carries, at its leading edge portion 26, a compressible pad 27 fabricated of, e.g., rubber, the pad 27 being adapted to overlie the leading fret 19*a* of a pair 19*a*, 19*b* of adjacent frets on the fingerboard 13 when the capotasto is installed with the fingerboard as shown in FIGS. 3 and 4. Preferably this compressible pad has a Shore A hardness of between about 50 and 70 (most preferred of about 60) so as to permit the pad to deform somewhat about the strings 15 it clamps on the leading fret 19*a* of the pair 19*a*, 19*b* of adjacent frets as the capotasto is installed. The trailing edge portion 29 of the force plate 25 is provided with a spacer pad 30 adapted to overlie the trailing fret 19*b* of a two adjacent fret pair 19*a*, 19*b*. This trailing spacer pad 30 may be of the same Shore A hardness as the leading clamping pad 27, or may be of a greater Shore A hardness so as to prevent it from deforming about the instrument's strings when the capotasto 10 is in clamping relation with the instrument's fingerboard 13. Note that the thickness T of the leading edge clamping pad 27 is the same as the thickness T' of the trailing edge spacer pad 30, relative to the plane 31 of the force plate 25, same being sufficient to accommodate the compression characteristics of the pads. This permits the force plate 25 to lie generally parallel to the fingerboard 13 across the frets 19*a*, 19*b* when the capotasto is installed thereon, see FIG. 3. Preferably the force plate 25 is fabricated of a spring steel that is flexible about the longitudinal axis 21 of the guitar's fingerboard 13 when the capotasto 10 is installed with the fingerboard, compare FIG. 4 to FIG. 5 which will be discussed in greater detail below. As used herein, the term leading fret refers to that fret 19*a* of two adjacent frets 19*a*, 19*b* which is closest to the instrument's body 12, and the term trailing fret refers to that fret 19*b* of two adjacent frets 19*a*, 19*b* which is farthest removed from the instrument's body.

The capotasto 10 also includes a novel clamp mechanism 40. This novel clamp mechanism 40 includes a force frame 41 and a clamp 42. The force frame 41 includes a rigid stationary post 43 fixed to one side edge 44 of the force plate and extends outwardly therefrom, the length L' of that post 43 being greater than the thickness T' of the instrument's neck 58 when the capotasto is installed therewith. An L-shaped latch arm 45 is pivotally connected at end 46 to the free end 47 of the post 43 by pin 48, the pivot axis 49 of that L-shaped latch arm 45 being disposed parallel to the longitudinal axis 21 of the fingerboard when the capotasto 10 is installed therewith. The non-pivoted or free end 50 of the L-shaped latch arm 45 is provided with a latch 51 having a detent lip 52 and a thumb plate 53, the latch arm's lip 52 being adapted to overlie and latch into latched relation with lip 54 on the edge 55 of the force plate 25. The force plate's edge lip 54, of course, is on the opposite edge 55 of the force plate 25 relative to that force plate edge 44 which carries the stationary post 43. The latch arm 45, which also constitutes part of the U-shaped force frame 41 is, therefore, adapted to pivot on axis 49 between an opened or installation position shown in phantom lines in FIG. 2 and a clamped or latched position shown in solid lines in FIG. 2.

The clamp mechanism 40 also includes the clamp 42 which is adjustably connected to the latch arm 45. The clamp 42 includes a curved yoke 39, the yoke being provided with a compressible glove 56 of, e.g., rubber, thereon for contact with the underside 57 of the instrument's neck 58 when the capotasto is installed. A yoke frame 59 is immobily connected to the yoke 39 as at 60, the frame 59 receiving a thumb screw 61 in freely rotating, non-threaded relation therewith as at 62. The thumb screw 61 is held in assembled relation with the yoke frame 59, i.e., in freely rotating assembled relation with the frame 59, by lock washer 63. The thumb screw 61, however, is threadedly received in cross bar 64 of the latch arm 45. Therefore, rotation of the thumb screw 61, through the threaded connection (as at 65) of that thumb screw with the latch arm's cross bar 64, causes the yoke 55 to retract or extend toward the capotasto's pressure plate 25. It is by virtue of this clamp 40, in cooperation with force frame 41, that the capotasto 10 is retained in operation relation with adjacent frets 19*a*, 19*b* on the guitar's fingerboard 13.

Use of the capotasto 10 of this invention is initiated by unlatching the latch arm 45 from force plate 25 through use of the latch's thumb plate 53, and allowing latch arm 45 (with clamp 40 attached thereto) to swing open about axis 49 into the phantom line position shown in FIG. 2. The capotasto 10 is then installed with the guitar's fingerboard 13 and neck 58 by causing the clamp pad 27 to overlie a leading fret 19*a* of two adjacent frets 19*a*, 19*b* as shown in FIG. 3. The leading edge portion 26 of the force plate 25 may be easily aligned over the leading fret 19*a* in a visual manner by the musician, or by feel through use of the musician's fingers, and once it is so positioned, the trailing edge portion 29 of the force plate similarly overlies the trailing fret 19*b* of the two adjacent frets 19*a*, 19*b*. With the capotasto's force plate 25 so positioned, the latch arm 45 is re-latched into operational force frame 41 relation with the force plate as shown in the solid line position of FIG. 2 and, as well as in FIGS. 3 and 4. And with the force plate 25 so aligned and the force frame 41 re-established, the capotasto's thumb screw 61 is threaded relative to the force frame's cross-bar 64 until the yoke 39 firmly embraces the underside 57 of the guitar's neck 58, thereby drawing down strings 15 against the adjacent frets 19*a*, 19*b*. In other words, because a drawdown force as shown by phantom arrows 67, 68 in introduced to the force plate 25 along opposite side edges 44, 55 thereof, the force plate is drawn down tightly against the leading 19*a* and trailing 19*b* frets of the two adjacent frets which the force plate overlies. As shown in FIG. 4, when the string contact edges 22 of those two frets are linear, the force plate retains its linearity in the installed use position shown. When the string contact surfaces 69 of those two adjacent frets 70, however, are curved as is shown in FIG. 5, the drawdown forces 67, 68 on the force plate's opposed side edges 44, 55 causes the force plate 25 to curve into general conformity with the curved stringed contact edges 69 to those curved frets since the force plate is fabricated of spring steel.

One of the primary advantages of the capotasto 10 of this invention is particularly illustrated in FIG. 3. As shown in that figure, the instrument's strings 15 are held snugly against the leading fret 19*a* by the clamp pad 27, and the hold-down pad 30 similarly presses the strings tightly against the trailing fret 19*b*. Thus, all the strings 15 are stretched between the contact edges 22 of the two adjacent frets 19*a*, 19*b*, and are not caused to bow down beneath those edges 22 toward the fingerboard's neck 58 and, particularly, are not bowed against the fingerboard's top surface 72. This is particularly desirable in that it permits the capotasto 10 of this invention to be installed on a stringed instrument's fingerboard 13, and the instrument thereafter used, without need for re-tuning of the instrument's strings 15, i.e., without need to readjust the strings' tension through the use of pegs 16 at the peg head 14. In the prior art, most commercially available capotastos make use of a force bar that depresses or bows the strings against the fingerboard's surface 72 in between two adjacent frets 19*a*, 19*b*, and this bowing of the strings causes the strings to stretch tighter due to the installed capotasto which, in turn, causes the pitch of the strings to be adversely affected. With such a prior art capotasto, re-tuning of the strings is required before the instrument can continue to be used by the musician after the capotasto is installed. Further, note particularly that the capotasto 10 of this invention does not extend significantly above the leading fret 19*a* which it serves, and that the clamp mechanism 40 is located in between the two adjacent frets 19*a*, 19*b*, when viewed in side view as shown in FIG. 3, thereby removing those structural features of the capotasto from significant hindrance of a musician's fingers while the instrument is being played with the capotasto installed thereon. Further, note the capotasto 10 of this invention can be easily moved between successive pairs of frets 19 simply by slightly loosening the clamp 40 and sliding the structure over the strings without hindrance from any capotasto structure, and without fear of latch 51 becoming disconnected.

Figure 7:
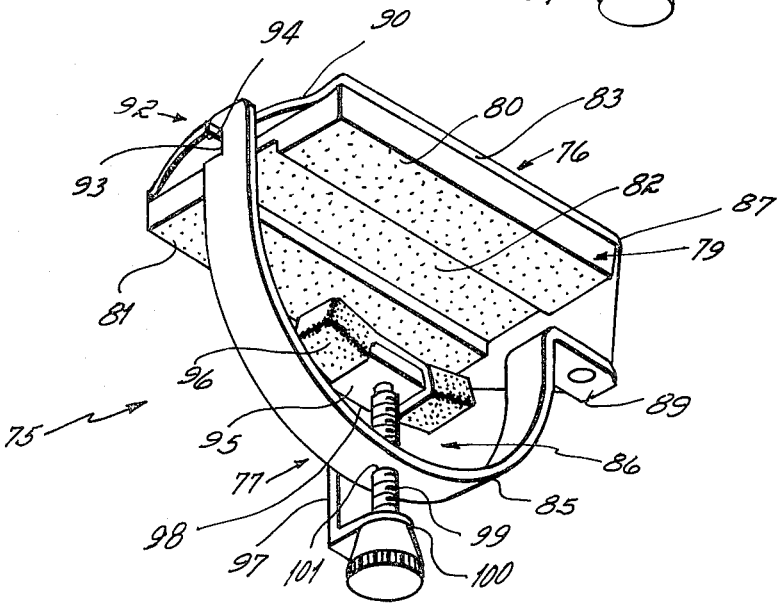
FIG. 7 is a perspective view of the capotasto shown in FIG. 6, but in closed or use configuration.

An alternative embodiment of a capotasto 75 in accord with the principles of this invention is illustrated in FIGS. 6 and 7. As shown, the second embodiment also includes a flexible force plate 76. The force plate 76 is of a length L′ great enough to overlie two adjacent frets 19*a*, 19*b* on the fingerboard of a guitar or other stringed instrument. This length L′ of the force plate 76 provides the same advantages and features to this second embodiment as was described in detail above in connection with the first embodiment capotasto 10. The force plate 76 is of a width W′ sufficient to overlie all strings on the stringed instrument's fingerboard. The force plate 76 includes a compressible rubber pad 79 of generally one piece configuration fixed thereto. The compressible pad 79 includes a leading edge section 80 and a trailing edge section 81, those sections being spaced one from another by means of a gap 82 having a depth D. The pad 79 itself is preferably fabricated of a rubber having a Shore A hardness of between about 50 and 70. When the capotasto is installed on the fingerboard of a stringed instrument, the leading pad 80 and trailing pad 81 overlie the leading and trailing frets of two adjacent frets, and when compressed thereagainst in use configuration the depth D of the gap therebetween is such that the instrument's strings between those frets are not bowed substantially beneath the contact edges of those frets, all as was described in detail above in connection with the first capotasto embodiment 10. The force plate 76 includes a base plate 83 preferably fabricated of a spring steel that is flexible about the longitudinal axis of an instrument's fingerboard when the capotasto is installed with the fingerboard, which provides the attendant advantages discussed in detail above with the first capotasto embodiment.

The capotasto 75 of the second embodiment further includes a clamp mechanism 77 that includes a force frame 85 and a clamp 86. The force frame 85 is of generally U-shaped configuration, and is of a rigid or non-flexible structural configuration. The U-shaped force frame 85 is connected to one side edge 87 of the force plate on pivot axis 88 through the frame's ear 89. Therefore, the force frame 85 is swingable into and out of latched relation with the other side edge 90 of the force plate 76 on a pivot axis 88 normal to the force plate along a swing path generally denoted by phantom arrow 91. The latch 92 structure by which the force frame 85 is latched to the force plate 79 includes a notch 93 at the free end of the force frame adapted to cooperate with a tongue 94 formed in the free edge 90 of the force plate.

The clamp 86 is adjustably connected to the U-shaped force frame 85. The clamp 86 includes a curved yoke 95 which carries a compressible glove 96 of, e.g., rubber, thereon for contact with the underside of an instrument's neck when the capotasto is installed in use. A yoke frame 97 is immobily connected to the yoke 95 as at 98, the frame receiving a thumb screw 99 in freely rotating, non-threaded relation therewith as at 100. The thumb screw 99 is held in assembled relation with the yoke frame, and in freely rotating assembled relation with the frame, by a lock washer (not shown). The thumb screw 99, however, is threadedly received as at 101 in the cross bar section of the U-shaped force frame. Therefore, and as with the first embodiment of the capotasto 10 described in detail above, rotation of the thumb screw 99 causes the yoke 95 to retract or extend relative to the capotasto's pressure plate 76, thereby permitting the capotasto 75 to be retained in operative relation with adjacent frets on a stringed instrument's fingerboard.

Having described in detail the preferred embodiment of my invention, what I desire to claim and protect by Letters Patent is:

1. A capotasto adapted for use with the fingerboard of a stringed instument, said fingerboard including a series of frets spaced one from another along the length thereof, said capotasto comprising a force plate, said force plate being of a length sufficient to permit the leading edge portion of said force plate to overlie a leading fret of two adjacent frets on said fingerboard, and to permit the trailing edge portion of said force plate to overlie the trailing fret of two adjacent frets on said fingerboard, when said capotasto is installed on said instrument, said force plate including clamp pad means to press the strings of said instrument against the string contact edges of both said adjacent frets without significant bowing of said strings below said contact edges toward the instrument's fingerboard, and a clamp mechanism connected to said force plate, said clamp mechanism cooperating with said force plate to retain said force plate in clamping relation with both said two adjacent frets when said capotasto is installed on said instrument.

2. A capotasto as set forth in claim 1, wherein said clamp pad means includes a compressible clamp pad mounted on the front edge portion of said force plate, said compressible clamp pad being adapted to overlie said leading fret of said two adjacent frets.

3. A capotasto as set forth in claim 2, said compressible clamp pad having a Shore A hardness between about 50 and about 70.

4. A capotasto as set forth in claim 1, said force plate and said clamp mechanism being structured to cooperate in flexing said force plate into a curved configuration generally matching the cross-sectional curvature of said instrument's fingerboard when said capotasto is installed in operation position on an instrument with a curved cross-section fingerboard.

5. A capotasto as set forth in claim 4, said latch comprising a first latch lip positioned at the free end of a latch arm, and a second latch lip mounted on one edge of said force plate, and said clamp device comprising a yoke adapted to engage the surface of said instrument's neck, and a thumb screw interconnecting said yoke and said latch arm.

6. A capotasto as set forth in claim 1, said clamp mechanism comprising a stationary post fixed to said force plate and extending outwardly therefrom, a latch arm pivotally connected to said post, the pivot axis of said latch arm being parallel to the axis of said fingerboard when said capotasto is installed on said instrument, a clamp device connected with said latch arm, said clamp device being adapted to induce clamping force on said force plate relative to said fingerboard, and a latch connected to said latch member at the nonpivoted end thereof, said latch cooperating with said force plate for restraining said latch arm in latched relation therewith, release of said latch permitting said latch arm and said clamp to drop away from said instrument's fingerboard while said force plate remains in position thereon as said capotasto is removed from assembled relation therewith.

7. A capotasto as set forth in claim 6, the length of said stationary post being greater than the thickness of said instrument's neck, and said latch arm pivot axis being positioned outwardly of that surface of said instrument's neck which is opposite to the fingerboard's surface.

8. A capotasto as set forth in claim 1, said clamp mechanism comprising a clamp adapted to bear against the underside of said instrument's neck at a longitudinal position along said neck that is substantially midway between said leading and trailing frets.

* * * * *